United States Patent [19]

Caboni

[11] 3,946,585

[45] Mar. 30, 1976

[54] DEVICE TO BE APPLIED TO A LATHE FOR SPINNING

[76] Inventor: Vittorio Caboni, Via Casteggio n.10-, Turin, Italy

[22] Filed: Dec. 30, 1974

[21] Appl. No.: 537,189

[30] Foreign Application Priority Data

Jan. 3, 1974 Italy ..... 67002/74

[52] U.S. Cl. ..... 72/83; 72/85; 72/441

[51] Int. Cl.[2] ..... B21D 22/16

[58] Field of Search ..... 72/82, 83, 85, 441; 60/468, 494

[56] References Cited

UNITED STATES PATENTS

| | | | |
|---|---|---|---|
| 1,916,433 | 7/1933 | Muller | 60/494 |
| 3,333,448 | 8/1967 | Ikert | 72/85 |

*Primary Examiner*—Lowell A. Larson

[57] ABSTRACT

The invention concerns a device to be applied to a lathe for spinning, comprising a carriage that is motor driven and movable along guides substantially parallel to the lathe axis, and a tool connected to an arm carried by the said carriage, in which the said tool-bearing arm is pivotally connected on one side to a lever that is manipulated by the operator, and on the other side is linked to a hydraulic cylinder, whose action on the tool is concordant with that of the lever and in which the pressure within a chamber and the outlet of fluid therefrom determine the thrust exerted by the said cylinder on the tool-bearing arm, said lever transmitting the operator effort to the said arm through the sliding piston of a valve which, under said effort, progressively throttles, against the pressure of the incoming fluid, an inlet port coaxial with said piston and communicating with said chamber of said hydraulic cylinder in order to regulate the pressure in said chamber and the outlet of fluid therefrom.

7 Claims, 2 Drawing Figures

DEVICE TO BE APPLIED TO A LATHE FOR SPINNING

Figure 1:
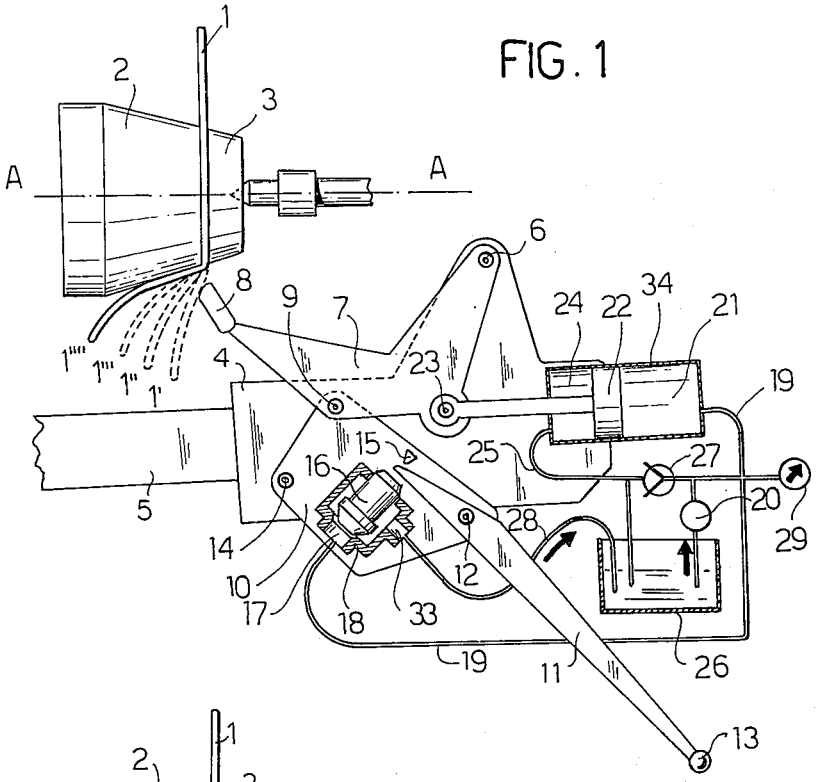

The present invention relates to a device to be applied to a lathe for spinning by mechanical means.

It is known that for this work discs of metal plate (for instance of iron, aluminum, brass, etc.) are employed, which discs are applied against a quickly rotating mould and are warped by exerting thereon a pressure by means of a rod-like tool acting as a lever which is abutted against a pin fixed to the lathe base, the other end of said tool being manipulated by the operator.

Such an operation may be carried out by hand, but the size of the employed disc and the speed of working are limited by the effort which the operator may exert and by the length of the arms of the lever forming the tool. Moreover the success of the operation depends greatly upon the skill of the operator.

It has been proposed to mechanize such an operation by means of devices which separate the effort exerted on the plate into two components of which one, having the greater intensity, is exerted by means of a motor-driven carriage in a direction substantially parallel to the lathe axis, and the other is exerted in a direction transverse to the first one by the operator which regulates the overall effort and the direction thereof.

In these devices most of the disadvantages due to the manual operation are eliminated, but, at least in case of works of great size, with discs of great thickness or hardness, there are still limits imposed by the physical effort required of the operator.

According to the invention on the contrary a mechanical device is provided in which only a portion of the second component of the pressure applied to the plate, reduced so as not to tire the operator, is exerted by hand, whereas the remaining portion of said component is exerted by a hydraulic cylinder.

The device according to the invention comprises a carriage that is motor driven and movable along guides substantially parallel to the lathe axis, and a tool, adapted to warp the rotating plate and carried by an arm mounted upon said carriage.

The tool-bearing arm is pivotally mounted on one side upon a lever that is manipulated by the operator, and on the other side it is linked to a hydraulic cylinder that the action on the tool is concordant with that of the lever and in which the pressure in a chamber and the outlet of liquid therefrom determine the thrust exerted by said cylinder on the tool-bearing arm, said lever transmitting the effort of the operator to said arm through the slidable piston of a valve, which piston, under said effort, progressively throttles against the pressure of the incoming fluid, an inlet port coaxial with the said piston and communicating with said chamber of said hydraulic cylinder, in order to regulate the pressure within said chamber and the outlet of liquid therefrom.

The ratio of the cross-sections of the said port and cylinder, taking into account the ratio of the lever arms, determines the proportion between the effort exerted by the operator and the effort applied to the plate.

The tool bearing arm may be pivotally mounted on the carriage at a point as near as possible to the lathe axis, or it may slide on a curved guide carried by the carriage and having its center of curvature located near the lathe axis, and preferably on the opposite side of the tool, with respect to the vertical plane passing through the said axis.

Figure 2:
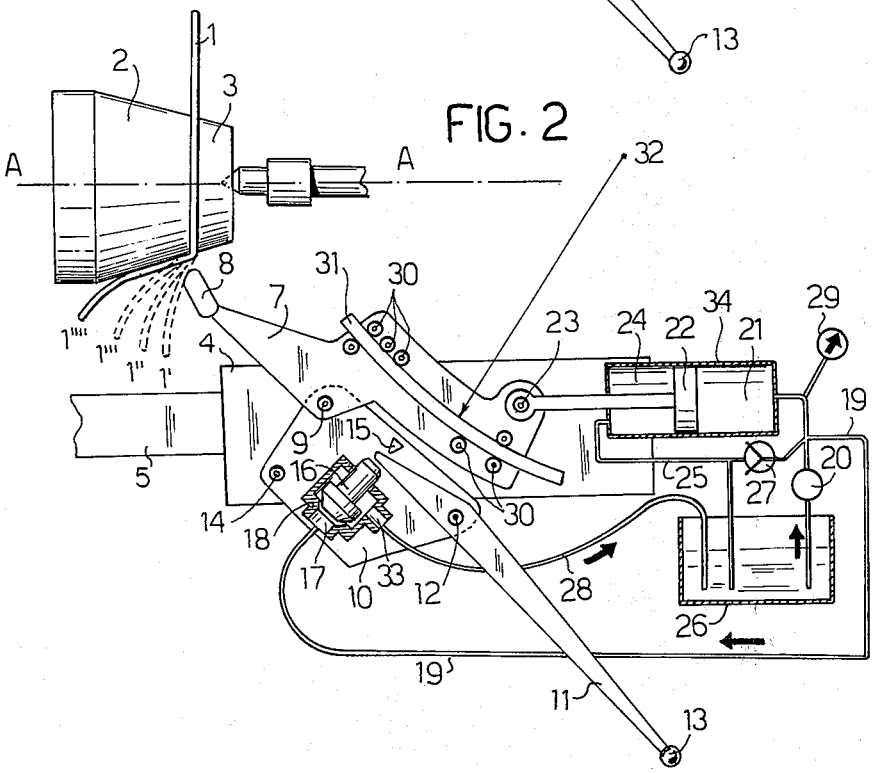

For a better comprehension reference is now made to the accompanying drawing, which shows some preferred embodiments of the invention, given by way of a non limitative example, and in which:

FIG. 1 is a diagrammatic plan view of some members of a lathe provided with the device according to the invention, and FIG. 2 is a view, similar to FIG. 1 and relating to a second embodiment of the invention.

FIG. 1 shows that a disc 1 of metal plate pressed between the bottom of a mould 2 and a counter-mould 3, is centered on the axis A — A of a spinning lathe. A carriage 4, driven by a motor, not shown, and movable in both directions along guides 5, preferably arranged in a direction substantially parallel to axis A — A, has pivotally mounted thereon, as shown by the reference character 6, an arm 7 bearing the tool 8. The arm 7 is also pivotally mounted, as shown by the reference character 9, on a lever comprising two portions 10, 11 pivotally connected to each other at point 12.

The portion 11, substantially rod shaped, has at one end 13 a handle bearing the controls of the device (forward and reverse movement of the carriage 4, etc.) not shown in the drawing, whereas the portion 10, which is substantially plate shaped, abuts as shown in 14 against a protrusion of carriage 4. The plate 10 which is solid includes a stop 15 that is adapted to limit clockwise rotation of lever 11, and also includes the body of a valve 18 in which slides a piston 16, operated by the counterclockwise rotation of lever 11.

The valve 18 has an inlet port 17 coaxial with the piston 16, which controls the opening of said port against the pressure of the incoming fluid, and an outlet port 33.

The inlet port 17 communicates, through a pipe 19, with the delivery of a pump 20 connected to a fluid reservoir 26, and with a chamber 21 of a hydraulic cylinder 34 carried by the carriage 4 and adapted to act on the tool 8 in a direction concordant with the action of lever 10, 11. The pipe 19 also provides communication between the pump 20 and the chamber 21.

The outlet 33 of valve 18 is connected to the reservoir 26 through a pipe 28.

The cylinder 34 has a slidable piston 22, of which the rod is pivotally connected at point 23 to the arm 7. A second chamber 24 of this cylinder communicates, through the pipe 25, with the reservoir 26. Pipe 25 also provides communication, through the non-return valve 27, of the chamber 24 with the chamber 21. A pressure-gauge 29 allows the pressure within chamber 21 to be detected and therefore the thrust exerted on the plate.

According to a modified embodiment (FIG. 2), the arm 7 instead of being pivotally mounted on the carriage 4, slides between rollers 30 along guides 31 rigidly connected to the carriage 4 and having preferably, the shape of arcs of circumference with the center thereof being at the point 32 and directed transverse to guides 5. By such an arrangement the tool-bearing arm may rotate about a point close to the vertical plane passing through axis A — A (even on the side opposite to the tool 8). This greatly facilitates the composition of the movements of arm 7 in order to give rise to the desired trajectories for the tool 8.

According to a variant the guides 31 may also be rectilinear.

The operation of the described device is as follows: after having mounted the disc 1 between mould 2 and countermould 3, and having put the lathe in rotation, with the operating end of tool 8 arranged in correspondence of the bottom of mould 2, the operator, by acting on handle 13, causes the carriage to move towards the left and, by manipulating the lever 10, 11, with successive passages and each time bringing the tool again to the starting position causes the tool to follow the trajectories 1', 1'', 1''', 1'''', . . . thereby giving to the plate the shape of a closer and closer bell, until the plate adheres to the mould.

As long as the trajectory of the tool is somewhat inclined with respect to the guide of the carriage, the pump 20 may be left inactive. The plate being worked exerts a reaction against tool 8 wich reaction tends to give rise to a counterclockwise rotation of arm 7 and to a sliding movement, towards the right, of piston 22. By manipulating the lever 11 so as to throttle the inlet port 17 of valve 18, thereby overcoming the pressure of the fluid coming from pipe 19, the fluid is prevented from going out of chamber 21, thereby increasing the pressure in said chamber and counteracting or offsetting the reaction of the plate.

When the pump 20 is operating, the same operative conditions are obtained even when the plate has reached a position parallel to the direction of guides 5 or has passed this position. In this case in fact the pressure fluid coming from the pump goes on one side into the chamber 21 and on the other side to the input 17 of valve 18. The operator, by acting on handle 13, may close more or less the inlet 17, thereby allowing a higher or respectively lower pressure to settle in chamber 21. Such a pressure is proportional to the action exerted on handle 13 and therefore to that portion of the warping effort which is hand exerted. The partial opening of said valve allows the fluid to pass through the outlet 33 and to go into the pipe 28 and then into the reservoir 26.

The present invention has been disclosed and illustrated with reference to two exemplary embodiments, but it is to be understood that changes and modifications are possible in the practice without departing from the scope of the invention.

Thus, for instance, while it has been stated that the piston 16 of the valve 18 is thrusted against the closure seat 17 directly by the end of the lever 11, the same result may be obtained by a cable under sheath (Bowden cable), which connects the end of lever 11 with the piston 16, with the advantage that it becomes possible to locate the valve 18 on the hydraulic cylinder, or in another suitable location, thereby eliminating the flexible pipes 19 and 28.

The same thrust may also be exerted through an independent hydraulic device, comprising a first hydraulic cylinder on the piston of which the lever 11 presses and which is connected through a flexible pipe to a second hydraulic cylinder which presses on the piston 16.

What is claimed is:

1. A device to be applied to a lathe for spinning, said device comprising a motor driven carriage, means for guiding said carriage along a path that is substantially parallel to the lathe axis, a tool-supporting arm mounted on said carriage, a lever pivotally connected at one end thereof to said arm, said lever being adapted to be manipulated by the operator, an hydraulic cylinder linked to the other end of said lever whereby the action of said cylinder on said tool-supporting arm is proportional to the force exerted by the manipulation of said lever, the pressure within said chamber of said cylinder and the outlet of fluid therefrom determining the thrust exerted by said cylinder on said tool-supporting arm, there being further included a valve having a sliding piston through which said lever transmits the force exerted by the operator to said arm, said valve also including an inlet port that is coaxial with said piston thereof, said inlet port communicating with said chamber of said hydraulic cylinder in order to regulate the pressure in said chamber thereof and the outlet of fluid therefrom whereby, as a result of the force exerted by said operator, said piston progressively throttles said inlet port in a direction against the pressure of the incoming fluid.

2. The device according to claim 1 wherein there is further included a pump, the output of which is in fluid communication with said inlet port of said valve and said chamber of said cylinder.

3. The device according to claim 1 wherein said lever comprises first and second sections hingedly connected to each other, said first section of said lever being pivotally mounted on said tool-supporting arm, said first section of said lever having an abuttment cooperating with said carriage, said first section of said lever supporting said valve, said second section of said lever having, at one thereof, a handle, the other end of said second section of said lever being arranged to operate said piston.

4. The device according to claim 1 wherein said tool-supporting arm is pivotally mounted on said carriage.

5. The device according to claim 1 wherein said tool-supporting arm includes a plurality of rollers and there is further included curved guide means rigidly secured to said carriage and having a center of curvature located near the lathe axis.

6. The device according to claim 5 wherein the center of curvature of said guidemeans is on the side opposite the tool with respect to a vertical plane passing through the lathe axis.

7. The device according to claim 1 wherein said tool-supporting arm includes a plurality of rollers and there is further included rectilinear guide means rigidly secured to said carriage.

* * * * *

UNITED STATES PATENT AND TRADEMARK OFFICE

CERTIFICATE OF CORRECTION

PATENT NO. : 3946585

DATED : March 30, 1976

INVENTOR(~~S~~) : VITTORIO CABONI

It is certified that error appears in the above-identified patent and that said Letters Patent are hereby corrected as shown below:

Claim 1 (Col. 4, line 11) change "other end of said lever" to --arm--

Signed and Sealed this

Twentieth Day of July 1976

[SEAL]

*Attest:*

RUTH C. MASON
*Attesting Officer*

C. MARSHALL DANN
*Commissioner of Patents and Trademarks*